US011136846B2

(12) United States Patent
Jamieson

(10) Patent No.: US 11,136,846 B2
(45) Date of Patent: Oct. 5, 2021

(54) CONTROLLING SUBSEA APPARATUS

(71) Applicant: Subsea 7 Limited, Sutton (GB)

(72) Inventor: James Andrew Jamieson, Balmedie (GB)

(73) Assignee: Subsea 7 Limited, Sutton (GB)

( * ) Notice: Subject to any disclaimer, the term of this patent is extended or adjusted under 35 U.S.C. 154(b) by 0 days.

(21) Appl. No.: 16/643,324

(22) PCT Filed: Aug. 30, 2018

(86) PCT No.: PCT/GB2018/052444
§ 371 (c)(1),
(2) Date: Feb. 28, 2020

(87) PCT Pub. No.: WO2019/043385
PCT Pub. Date: Mar. 7, 2019

(65) Prior Publication Data

US 2020/0378208 A1 Dec. 3, 2020

(30) Foreign Application Priority Data

Aug. 30, 2017 (GB) ..... 1713911

(51) Int. Cl.
*E21B 33/035* (2006.01)
*E21B 34/04* (2006.01)
*E21B 41/04* (2006.01)

(52) U.S. Cl.
CPC ..... *E21B 33/0355* (2013.01); *E21B 34/04* (2013.01); *E21B 41/04* (2013.01)

(58) Field of Classification Search
CPC .. E21B 33/0355; E21B 34/04; E21B 41/0007; E21B 41/04; E21B 41/0085
See application file for complete search history.

(56) References Cited

U.S. PATENT DOCUMENTS

| | | | | |
|---|---|---|---|---|
| 3,621,911 | A | 11/1971 | Baker et al. | |
| 4,730,677 | A | 3/1988 | Pearce et al. | |
| 6,167,831 | B1 | 1/2001 | Watt et al. | |
| 7,650,943 | B2 | 1/2010 | Baggs | |
| 9,097,066 | B2 | 8/2015 | Hensley et al. | |
| 9,200,497 | B1 * | 12/2015 | Lugo | E21B 34/16 |
| 9,458,689 | B2 | 10/2016 | Mancuso et al. | |
| 2002/0011335 | A1 * | 1/2002 | Zhang | H04B 13/02 166/335 |
| 2003/0153468 | A1 | 8/2003 | Soelvik | |

(Continued)

FOREIGN PATENT DOCUMENTS

| | | |
|---|---|---|
| GB | 2523388 | 8/2015 |
| KR | 2016-0072308 | 6/2016 |

(Continued)

*Primary Examiner* — James G Sayre
(74) *Attorney, Agent, or Firm* — Levy & Grandinetti

(57) ABSTRACT

An auxiliary control system, having a method for controlling same, controls subsea equipment such as a tree or manifold, for example, in the event of failure of a control umbilical. A power unit is installed subsea, and then a control tool is coupled to the subsea equipment. Control signals from topside source are transmitted to the power unit, which powers and controls the control tool in response to the control signals to operate a control element of the subsea equipment, such as a valve.

20 Claims, 3 Drawing Sheets

(56) References Cited

U.S. PATENT DOCUMENTS

Figure 1:
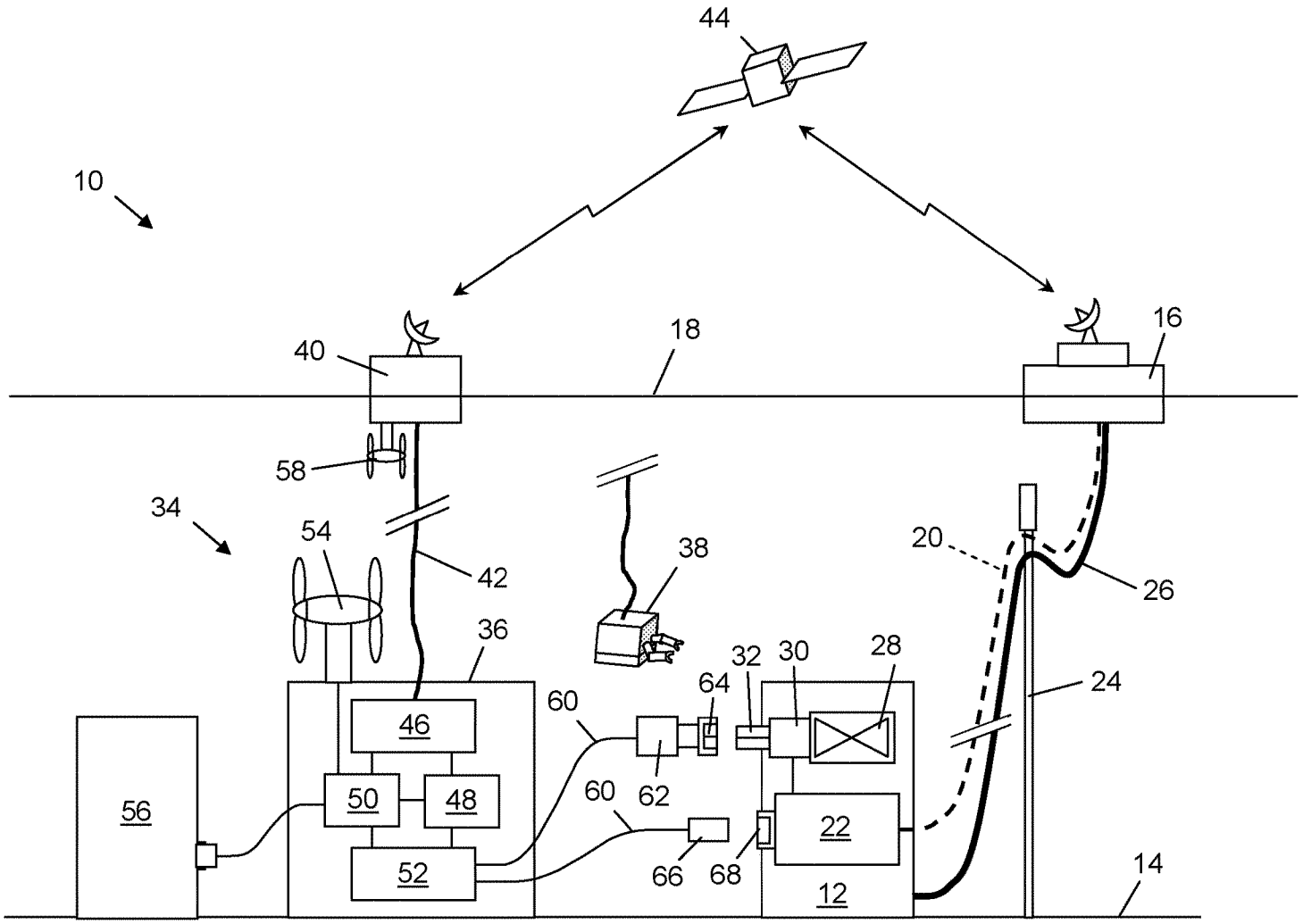

| | | | | |
|---|---|---|---|---|
| 2009/0114140 | A1* | 5/2009 | Guerrero | B63C 11/52<br>114/321 |
| 2012/0111572 | A1* | 5/2012 | Cargol, Jr. | E21B 33/064<br>166/363 |
| 2017/0026085 | A1 | 1/2017 | Kerins et al. | |
| 2018/0252065 | A1* | 9/2018 | Hemphill | E21B 33/064 |

FOREIGN PATENT DOCUMENTS

| | | |
|---|---|---|
| WO | WO 01/21479 | 3/2001 |
| WO | WO 2007/016678 | 8/2007 |
| WO | WO 2011/041525 | 4/2011 |
| WO | WO 2015/001377 | 1/2015 |

* cited by examiner

CONTROLLING SUBSEA APPARATUS

This invention relates to the challenges of controlling subsea apparatus, especially maintaining control of such apparatus in the event that a primary control system should fail.

Subsea control systems are used to actuate control elements of subsea apparatus, such as valves and pumps. Specific examples of such control elements are valves incorporated in subsea manifolds or trees, as are used to produce oil and gas offshore.

Usually, a subsea control system responds to commands from a topside facility that may be located on an offshore platform or on land. In the subsea oil and gas industry, the topside facility typically comprises a control room in which operators and computer systems monitor a subsea production field and control its operation.

In normal use, a subsea control system works by actuating valves or other subsea control elements remotely. It does so by applying electrical and/or hydraulic power to those elements via one or more umbilicals extending from the surface to the subsea apparatus.

Generally, the subsea part of the control system is implemented in replaceable pods that are each powered directly by an umbilical. If components such as valves in the pod should fail or require maintenance, the umbilical is disconnected from the pod and recovered to the surface to allow the pod to be lifted and replaced. The umbilical is then deployed back underwater and connected to the replacement pod. However, umbilical recovery and deployment is a lengthy and risky operation. This is because an umbilical is often mechanically attached to a production riser system in order to avoid fatigue that would be caused by free flotation as a catenary from the surface.

If an umbilical itself fails or is damaged, it cannot provide power to the associated control elements and so must be replaced or repaired. This is also a lengthy and risky operation. Meanwhile, auxiliary control measures must be used instead.

In an emergency, auxiliary control may involve an unmanned underwater vehicle (UUV), such as an ROV, operating a subsea control element directly. In sufficiently shallow water, a diver may do so instead. For example, a UUV or a diver may close a subsea valve to shut down or to divert a flow of production fluid by coupling a torque tool to a coupling formation, such as a socket or a spigot, connected to that valve. However, this does not obviate the need eventually to replace or repair the umbilical. Nor is it a practical solution to the need for ongoing continuous operational control of the system for as long as the umbilical is out of action.

U.S. Pat. No. 9,458,689 shows how functional blocks of a subsea system may be separable in order to simplify maintenance and replacement. Here, a wellhead control system is designed in modules and a control umbilical may be distinct from the riser. However, this system is not suitable for retrofitting to older oil fields. A control umbilical is also deployed independently of a riser in U.S. Pat. No. 9,097,066.

WO 2007/016678 teaches repair methods in which an ROV bypasses malfunctioning hydraulic systems. For this purpose, a jumper hose is connected to the inlet and outlet of the control system.

WO 2011/041525 discloses subsea hydraulic control using a separate umbilical from the surface.

U.S. Pat. No. 7,650,943 discloses a remote control system in which a source of hydraulic pressure is located on the wellhead. This obviates any hydraulic line between the wellhead and the control system. However, this arrangement is also unsuitable for retrofit as the hydraulic source has to be preliminarily mounted on the wellhead.

US 2012/111572 describes an emergency control system (ECS) for a subsea blowout preventer (BOP).

Against this background, the invention provides an auxiliary control system for controlling subsea equipment. The system comprises a subsea-installed power unit having an on-board battery and a power supply. A data capture device is connected to the power unit by a subsea communications link, the data capture device being arranged to capture control signals issued from a remote topside source and to transmit those signals to the power unit along the communications link. For example, the remote topside source may be a topside installation connected to the subsea equipment by an umbilical.

At least one control tool is connected to the power supply to receive power from the power unit and is movable relative to the power unit to be coupled to the subsea equipment, enabling the coupled control tool to operate at least one control element of the subsea equipment in response to the control signals.

The data capture device may be supported by a surface buoy to receive control signals transmitted from the remote topside source through air. In that case, the buoy is suitably anchored by the power unit via a tether extending from the power unit to the buoy. The tether may incorporate the communications link.

In another approach, the data capture device may be coupled to a subsea data carrier to receive control signals transmitted from the remote topside source along the data carrier.

Conveniently, the buoy may support at least one electricity-generation device and a power line connects that device to the battery of the power unit. The power line may extend along the aforementioned tether.

At least one power connector may be movable relative to the power unit to be coupled to the subsea equipment, that connector being connected to the power supply to receive power for energising the subsea equipment.

The power supply preferably comprises both an electrical power supply and a hydraulic power supply. The hydraulic power supply may be pressurised by a pump that is driven by a motor powered by the electric power supply.

Advantageously, the or each control tool may be connected to the power supply by a flying lead or flexible hose.

A current turbine may conveniently be supported on the power unit and be connected to the power unit to charge the battery. The battery may also be charged by a power connection between the power unit and a power supply of another item of subsea equipment.

The system of the invention may further comprise a subsea-installed robotised positioning system for moving the or each control tool between different locations on the subsea equipment. This allows the system to operate different control elements of the subsea equipment in succession.

The inventive concept extends to a corresponding method for controlling subsea equipment. The method comprises: installing a power unit subsea; moving at least one control tool relative to the power unit to couple the control tool to the subsea equipment; capturing control signals issued from a remote topside source and transmitting those signals to the power unit; powering the control tool from the power unit; and using the coupled control tool to operate at least one control element of the subsea equipment in response to the control signals.

The control signals are preferably captured at a surface location but could be captured from a subsea data carrier. Electrical power may also be generated at the surface location and transmitted from the surface location to charge a battery of the power unit.

At least one power connector may be moved relative to the power unit to couple the connector to the subsea equipment. Power may then be provided to the connector from the power unit to energise the subsea equipment.

Electrical and hydraulic power may be provided from the power unit. Hydraulic power may conveniently be produced from electric power onboard the power unit.

Where the remote topside source of control signals is a topside installation connected to the subsea equipment by an umbilical, the method of the invention is apt to be performed in response to failure of, or damage to, the umbilical.

In summary, therefore, the invention provides an alternative retrofit or repair system that removes the need for umbilical operations. The invention simplifies retrofit or repair operations by providing a separate backup device that provides control functions externally to a wellhead, namely hydraulic and/or electric power supply, plus control from the surface, while limiting the need for physical power or hydraulic lines between the surface and the wellhead.

It is straightforward and quick to install a backup device of the invention, which can then be left in place for as long as necessary. Indeed, if the backup device can be left in place, it may not be necessary to replace or repair a failed component, such as a damaged umbilical, that prompted the installation of that device.

Preferred embodiments of the invention provide a backup device for a subsea control system. At least one electric and/or hydraulic flying lead or hose may connect the backup device to a wellhead.

The device of preferred embodiments comprises at least one support that can be positioned on the seabed, distinct from the structure of the control system. The device further comprises an electric power supply and a hydraulic pressure supply powered by a source of electric power mounted on the support. A control pod, which could be distinct from the hydraulic pressure supply, is arranged to energise wellhead components by virtue of the electric power supply and/or the hydraulic pressure supply.

At least one onboard battery provides power to the electric power supply. The battery is preferably the primary source of power for the device but may be charged by connection to a subsea structure, through a cable to a buoy such as a surface communication buoy, by being connected to a UUV and/or by a current turbine mounted on the support.

A signal transmission means provides for communication with a surface communication buoy. For example, the signal transmission means may comprise a cable suspended from the buoy. The signal transmission means may however be wireless. The signal transmission means may interface with a pre-existing umbilical or riser, for example by inductive coupling.

Preferred embodiments of the invention also implement a method for controlling a subsea control system. The method comprises: installing near the subsea control system an external backup control system comprising a frame, an electric power supply powered by a battery, an electrically-powered hydraulic pressure supply and a control pod. An electrical connection may be made between the external backup control system and a subsea structure to charge the battery. The external backup control system exchanges signals with a surface communication buoy.

Thus, when an existing control umbilical has failed or is damaged, a unit of the invention can be deployed by UUV or diver intervention onto an associated subsea system, such as a subsea tree or manifold, to enable control to be restored. Thus, subsea tooling is connected to the subsea system, a power and communications unit is located subsea and connected to the tooling, and a surface buoy connected to the power and communications unit provides a remote control link to shore or a platform.

The power and communications unit can be configured to provide electrical and/or hydraulic power to the tooling. The tooling can be fixed or movable after installation to access multiple locations on the subsea system, for example being moved by a manipulating arm of a UUV or by a diver, or being mounted on a robot capable of actuating movement of the tooling on x-, y- and z-axes. Such a robot may be separate from or attachable to the power and communications unit. The unit itself need have no on-board means for moving the tooling relative to the unit.

The power and communications unit has a built-in battery whose capacity may enable several months of operation. Nevertheless, the battery can be recharged or replaced by UUV or diver intervention. Alternatively the surface buoy can have a power generation capability, using current, wave, wind and/or solar generation, to keep the battery charged. It is also possible for the battery to be charged by a subsea current turbine. Conveniently, such a turbine may be mounted on the power and communications unit itself.

Hardware implementing the invention is apt to be provided in one or more discrete units, structures or frames, such as subsea skids, that may be self-supporting or attachable to subsea apparatus or equipment. As such a unit may need to remain on station for a long period of time, then unlike a UUV it requires no self-propulsive capability.

Thus, the inventive concept embraces both an auxiliary control system and a method for controlling subsea equipment such as a tree or manifold, for example in the event of failure of a control umbilical. A power unit is installed subsea and then a control tool is coupled to the subsea equipment. Control signals from a topside source are transmitted to the power unit, which powers and controls the control tool in response to the control signals to operate a control element of the subsea equipment, such as a valve.

Figure 2:
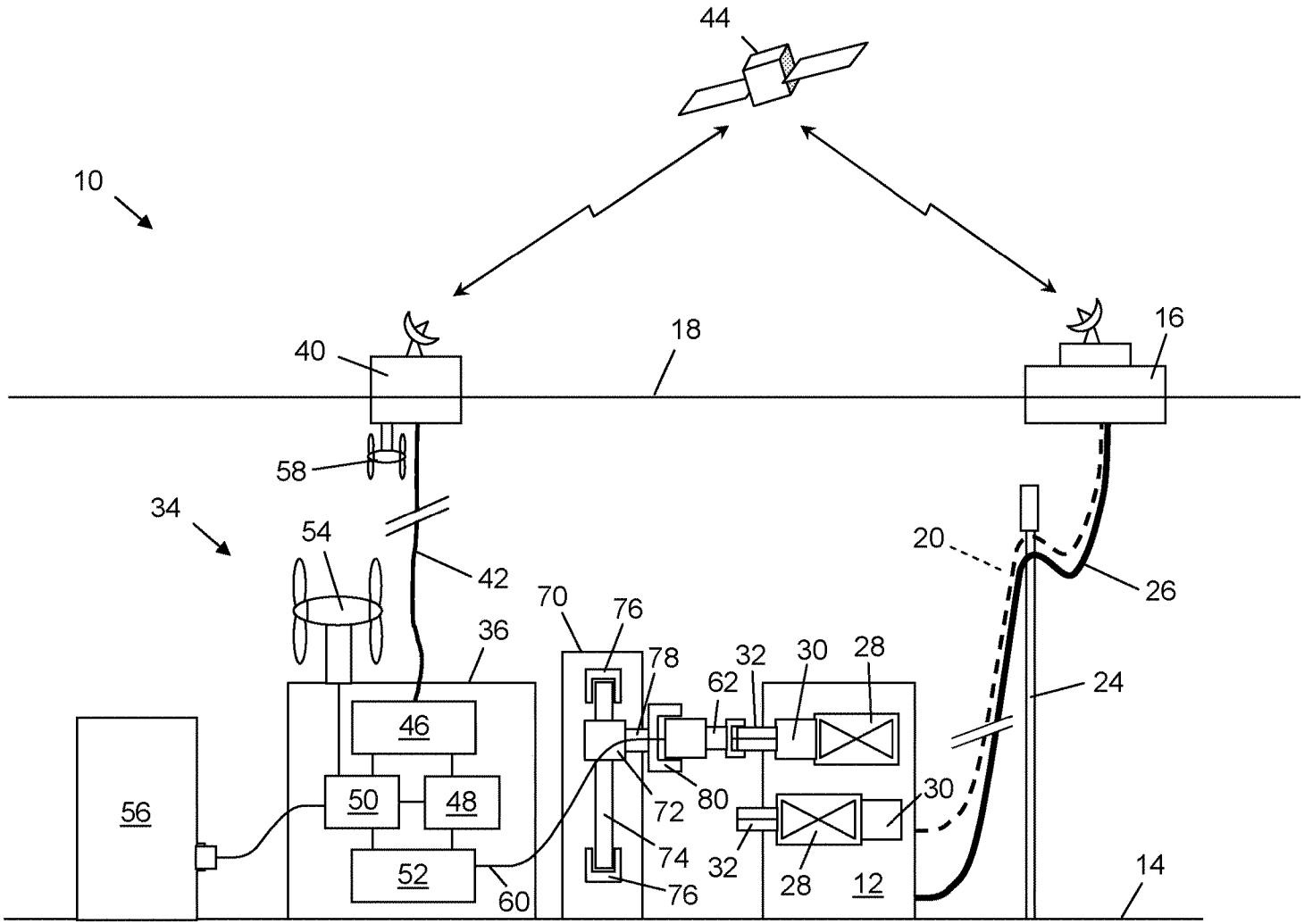

In order that the invention may be more readily understood, reference will now be made, by way of example, to the accompanying drawings in which:

FIG. 1 is a schematic side view of a backup unit of the invention being used to control subsea apparatus;

FIG. 2 corresponds to FIG. 1 but shows a variant of the invention; and

Figure 3:
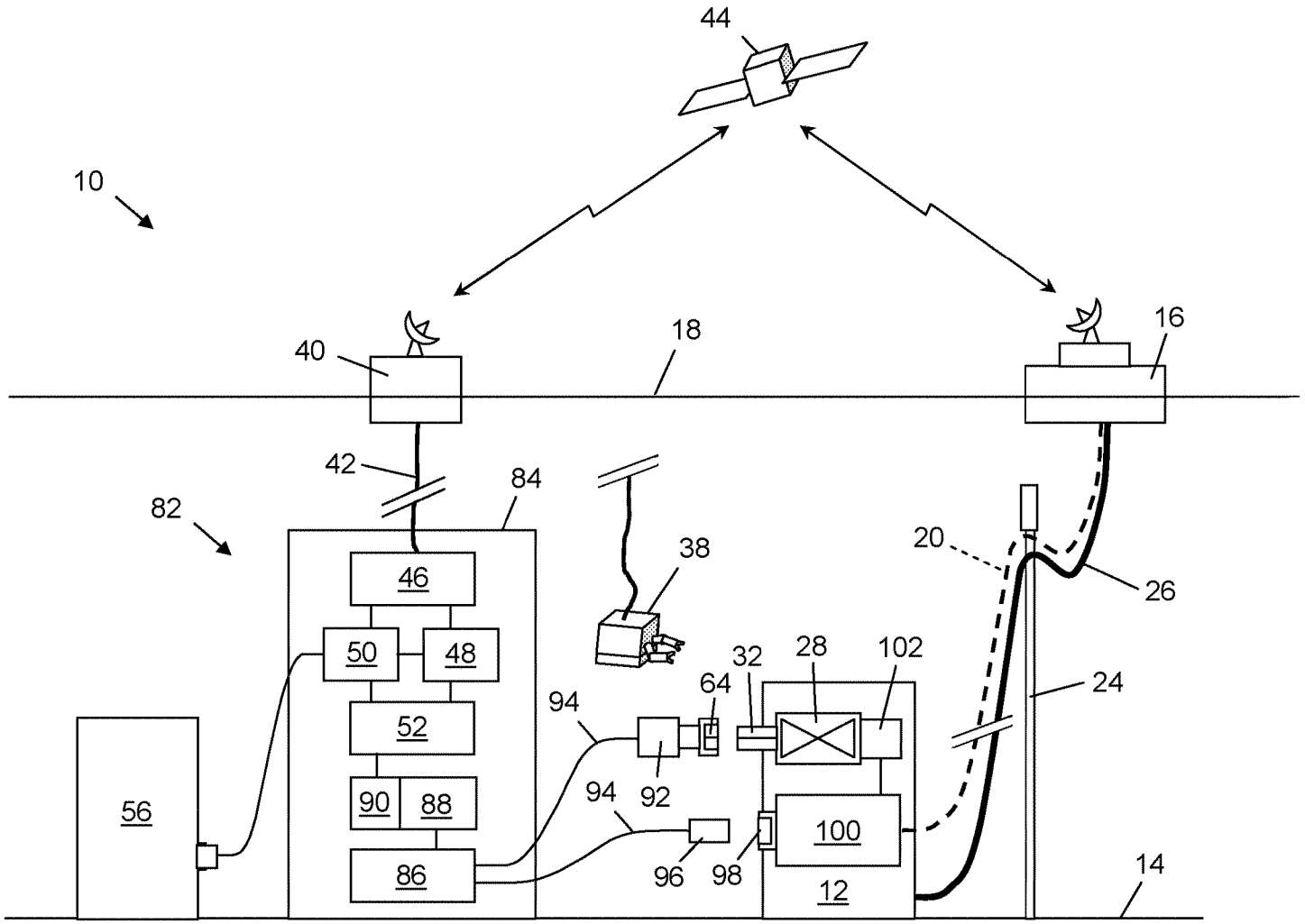

FIG. 3 corresponds to FIGS. 1 and 2 but shows another variant of the invention.

The drawings are schematic and much-simplified, and are not to scale. Like numerals are used for like features.

Referring firstly to FIG. 1 of the drawings, a subsea installation 10 comprises subsea apparatus exemplified here as a tree 12 atop a wellhead on the seabed 14. The tree 12 and other parts of the subsea installation 10 are controlled from a topside installation exemplified here as a platform 16 that floats on the surface 18. The topside installation could instead be on land, or control of the subsea installation 10 could be distributed between onshore and offshore locations.

Normally, the tree 12 is controlled via an umbilical 20 hanging from the platform 16 between the surface 18 and the seabed 14. Thus, the umbilical 20 transmits control signals between the platform 16 and the tree 12. In this example, the umbilical 20 also provides hydraulic power to a control pod 22 of the tree 12 and optionally also provides electric power to the tree 12. However, it would be possible for the umbilical 20 to transmit data signals and for the tree 12 to be powered from another source, such as a subsea power network.

As is common, the umbilical 20 may be part of a production riser system. A production riser system is exemplified here by a riser tower 24 that supports the umbilical 20 in parallel with flowlines 26 extending from the seabed 14 to the platform 16 at the surface 18.

A subsea tree will typically support a multiplicity of hydraulically and/or electrically powered control elements. However, for simplicity and ease of understanding, the tree 12 shown here has just one flow control element, which is exemplified here as a hydraulically-powered valve 28.

In normal operation, the valve 28 is adjusted by an actuator 30 that is driven through the control pod 22 of the tree 12 in response to hydraulic pressure and eventually control signals received from the platform 16 via the umbilical 20. However, in an emergency such as a power failure, the valve 28 may be adjusted by an ROV or diver using a torque tool to engage and turn a coupling formation of the actuator 30. The coupling formation is exemplified here as a spigot 32 protruding from a face of the tree 12. Monitoring signals from the control pod 22, for example flow rate and the position of the valve actuator 30, are sent back to the platform 16 via the umbilical 20.

If the umbilical 20 fails or is damaged so that the tree 12 can no longer receive or send control signals and receive power, automatic fail-safe measures may be implemented in the tree 12. However, normal control of the tree 12 can only be reinstated by repairing or replacing the umbilical 20. This is a difficult and potentially hazardous prospect in view of the proximity of the umbilical 20 to other parts of the riser system.

In this situation, the backup system 34 of the invention is apt to be installed as shown. The backup system 34 comprises a subsea power and communications unit 36 that can be installed on or adjacent to the tree 12. For instance, the subsea unit 36 may be placed and left on the seabed 18 by a diver or by an ROV 38 as shown here.

In this example, the system 34 further comprises a surface buoy 40 that is connected to the subsea unit 36 by a data cable 42. Conveniently, the data cable 42 constitutes, or forms part of, a tether for the buoy 40, which may therefore be anchored by the subsea unit 36.

The buoy 40 establishes data communication between the platform 16 and the subsea unit 36, whereby a control room on the platform 16 can control the backup system 34 and hence the installation 10, and can act on monitoring signals sent back to the platform 16. In this example, the data communication link is via a satellite 44. However a local wireless data network such as a 4G network may suffice, particularly if reliable line-of-sight communication is possible between the buoy 40 and the platform 16.

Control signals sent from the platform 18 via the buoy 40 and the cable 42 are received by a communications interface 46 and processed by a controller 48 of the subsea unit 36. The communications interface 46 and the controller 48 are powered by an on-board battery 50 of the unit 36. The battery 50 also provides power to an electrical power supply 52 of the unit 36 under the control of the controller 48.

The battery 50 of the subsea unit 36 may be replaceable or chargeable periodically by UUV or diver intervention but is preferably charged continuously subsea. Various examples of subsea charging systems are shown here. One example is a current-driven turbine 54 that is, conveniently, supported by the subsea unit 36 serving as a foundation. Another example involves connecting the battery 50 to a power supply of another item of subsea apparatus, such as via the power cable shown here extending across the seabed 18 from the power supply of another tree 56.

Another way of charging the battery 50 of the subsea unit 36 is to use the surface buoy 40 as a support for a generating system and to use the data cable 42, or a parallel power cable, to convey the resulting electrical power to the unit 36. Such a generating system is exemplified here by a current-driven turbine 58 hanging under the buoy 40. It will be apparent to the skilled reader that other generating systems could be supported by the buoy 40, such as systems powered by wind, waves or solar energy.

The power supply 52 of the subsea unit 36 is connected to at least one flexible flying lead 60 that carries electrical current from the power supply 52 to a tool or connector at the free end of the lead 60. To show both such possibilities, there are two such leads 60 in the example shown in FIG. 1.

One lead 60 supplies power to an electrically-driven torque tool 62 that may be held and manipulated by the ROV 38 or by a diver. The torque tool 62 has a rotary coupling formation that, in this example, is a socket 64 that receives and complements the spigot 32 protruding from the tree 12. In this way, the torque tool 62 can be coupled for torque transmission to the actuator 30 of the tree 12.

Coupling the torque tool 62 to the actuator 30 in this way allows the valve 28 to be operated again under the control of the platform 16, acting via the communications link and the backup system 34. The torque tool 62 can then be removed by the ROV 38 or by a diver, or may be left coupled to the actuator 30 so that the platform 16 can continue to control the tree 12 via the backup system 34. Thus, the backup system 34 of the invention can be used to regain and to maintain control of the tree 12.

The other lead 60 supplies power to an electrical connector element that is exemplified here as a wet-mateable plug 66. The plug 66 may be held and manipulated by the ROV 38 or by a diver to fit into a complementary socket 68 on the tree 12. This enables electrical power to be supplied from the battery 50 of the subsea unit 36 to the control pod 22 of the tree 12. The control pod 22 may then be able to drive the actuator 30 to operate the valve 28 in the event that the normal electrical power supply to the tree 12 has failed but the umbilical 16 is still capable of transmitting control signals to the tree 12.

Other power-transmitting, optionally contactless couplings, such as inductive couplings, would be possible instead of a contact system such as the illustrated plug 66 and socket 68.

As noted above, a subsea tree will typically support a multiplicity of control elements such as valves. Each such control element may have a respective coupling formation such as a spigot 32 like that shown in FIG. 1. The skilled reader will appreciate that the subsea unit 38 could host and control more than one item of tooling such as a torque tool 62 or a power connector element such as a plug 66. This would allow more than one valve 28 or other control element to be controlled or powered simultaneously. In another approach, the torque tool 62 can be moved by the ROV 38 or by a diver to engage with different coupling formations and hence to operate different control elements in turn.

Turning next to FIG. 2, this drawing largely corresponds to FIG. 1 but shows how the backup system 34 of the invention may be adapted by the addition of a robot 70 that is capable of holding and moving the torque tool 62 on x-, y- and z-axes. The robot 70 allows the torque tool 62 to be moved to interact with the coupling formations of multiple control elements but without requiring an ROV or a diver to remain on station to do so.

To illustrate this principle with simplicity, FIG. 2 shows the tree 12 as having two control elements again exemplified as valves 28, each having a coupling formation in the form of a spigot 32. There may of course be more than two control elements and coupling formations in a one-dimensional or two-dimensional array. To aid clarity, some features of FIG. 1 have been omitted even if they would still be present, notably the ROV 38 and the control pod 22 of the tree 12. One of the valves 28 is a smaller, electrically-powered valve, actuated by an actuator 30. In this alternative embodiment the spigot 32 bypasses the actuator 30 to act on the stem of the valve 28.

In this example, the robot 70 comprises a carriage 72 that can be moved along a rail 74. The rail 74 itself can be moved along guides 76 in a direction orthogonal to its length. This allows the carriage 72 to be moved in a plane along two mutually-orthogonal axes into alignment with any of a two-dimensional array of coupling formations such as the spigots 62. To enable movement on a third axis orthogonal to the plane and hence toward or away from the spigots 62 of the tree 12, the carriage 72 supports a telescopic mount 78 having a grab 80 at its free end facing the tree 12. The grab 80 can grasp or release a torque tool 62 to move the torque tool 62 between spigots 32.

The robot 70 could be implemented in various other ways, for example by an articulated arm. More generally, the robot 70 may be mounted on the subsea unit 36 or may be separate from the subsea unit 36 as shown, either being free-standing or attached to the tree 12.

Turning finally to FIG. 3 of the drawings, this shows how a backup system 82 of the invention may be adapted to provide hydraulic energy instead of, or in addition to, the provision of electrical energy as in FIG. 1. Again, some features shown in FIG. 1 have been omitted from FIG. 3 for clarity even if they may still be present, notably the current-driven turbines 54 and 58 that were mounted, respectively, on the subsea unit 36 and the surface buoy 40.

The subsea unit 84 of FIG. 3 contains all of the features shown in the subsea unit 36 of FIG. 1 but is adapted by the addition of a hydraulic power supply 86. Specifically, the hydraulic power supply 86 is fed with hydraulic pressure by a pump 88, such as a vane pump, driven by an electric motor 90. The motor 90 is driven in turn by the electrical power supply 52 of the subsea unit 84.

The hydraulic power supply 86 of the subsea unit 84 in FIG. 3 enables the backup system 82 of the invention to support hydraulically-driven tooling such as a torque tool 92, which in this instance is coupled to the hydraulic power supply 86 by a flexible hydraulic hose 94. Like the torque tool 62 of FIGS. 1 and 2, the torque tool 92 may be held and manipulated by the ROV 38, by a diver, or by a robot 70 like that shown in FIG. 2.

In a manner analogous to the electrical supply provisions of the subsea unit 36 shown in FIG. 1, the hydraulic power supply 86 of the subsea unit 84 in FIG. 3 also supports a second hydraulic hose 94. The second hydraulic hose 94 terminates in a connector element such as a plug 96 that may also be held and manipulated by the ROV 38, by a diver, or by a robot 70 like that shown in FIG. 2.

Again, the plug 96 can be engaged with a complementary socket 98 on the tree 12. This connection enables hydraulic power to be supplied from the hydraulic power supply 86 of the subsea unit 84 to a hydraulic power supply 100 of the tree 12. The power supply 100 may then be able to drive a hydraulic motor 102 to operate the valve 28 in the event that the normal hydraulic power supply to the tree 12 has failed but the umbilical 16 is still capable of transmitting control signals to the tree 12.

Whilst not shown in FIG. 3 for clarity, it will be apparent that, as in FIGS. 1 and 2, the electrical power supply 52 of the subsea unit 84 can be connected by respective flying leads 60 to tooling such as an electrically-driven torque tool 62 and/or an electrical connector element such as plug 66. Similarly, the tree 12 shown in FIG. 3 may also have an electrical control pod 22 like that shown in FIGS. 1 and 2.

Many other variations are possible within the inventive concept. For example, the data cable between the subsea unit and the surface buoy could be obviated by wireless subsea data transmission. Data communication between the subsea unit and a controlling topside installation could also be effected in other ways, for example, by establishing a data connection through a pre-existing umbilical of the subsea installation. Inductive coupling with the pre-existing umbilical is one way of establishing such a connection.

The invention claimed is:

1. An auxiliary control system for controlling subsea equipment, the system comprising:

a subsea-installed power unit having an on-board battery and a power supply;

a data capture device connected to the power unit by a subsea communications link, the data capture device being arranged to capture control signals issued from a remote topside source and to transmit those signals to the power unit along the communications link;

at least one control tool that is connected to the power supply by a first flying lead or flexible hose to receive power from the power unit and that is movable relative to the power unit to be coupled to the subsea equipment, enabling the coupled control tool to operate at least one control element of the subsea equipment in response to the control signals, wherein the at least one control tool is a torque tool that when coupled enables torque transmission to the subsea equipment to operate the at least one control element; and at least one power connector that is movable relative to the power unit to be coupled to the subsea equipment and that is connected to the power supply by a second flying lead or flexible hose to receive power for energising the subsea equipment, wherein energising the subsea equipment comprises providing power to a control pod of the subsea equipment to enable the control pod to operate the at least one control element.

2. The system of claim 1, wherein the data capture device is supported by a surface buoy to receive control signals transmitted from the remote topside source through air.

3. The system of claim 2, wherein the buoy is anchored by the power unit via a tether extending from the power unit to the buoy.

4. The system of claim 3, wherein the tether incorporates the communications link.

5. The system of claim 2, wherein the buoy supports at least one electricity-generation device and a power line connects that device to the battery of the power unit.

6. The system of claim 1, wherein the data capture device is coupled to a subsea data carrier to receive control signals transmitted from the remote topside source along the data carrier.

7. The system of claim 1, wherein the power supply comprises an electrical power supply and a hydraulic power supply.

8. The system of claim 7, wherein the hydraulic power supply is pressurised by a pump that is driven by a motor powered by the electric power supply.

9. The system of claim 1, further comprising a power connection between the power unit and a power supply of another item of subsea equipment to charge the battery.

10. The system of claim 1, further comprising a subsea-installed robotised positioning system for moving the or each control tool between different locations on the subsea equipment to operate different control elements of the subsea equipment in succession.

11. A method for controlling subsea equipment, the method comprising:

installing a power unit subsea;

moving at least one control tool relative to the power unit to couple the control tool to the subsea equipment, where the at least one control tool is connected to the power unit by a first flying lead or flexible hose and wherein the at least one control tool is a torque tool;

capturing control signals issued from a remote topside source and transmitting those signals to the power unit;

providing power to the control tool from the power unit;

using the coupled control tool to transmit torque to the subsea equipment to operate at least one control element of the subsea equipment in response to the control signals;

moving at last one power connector relative to the power unit to couple the connector to the subsea equipment, wherein the at least one power connector is connected to the power unit by a second flying lead or flexible hose; and providing power to the connector from the power unit to energise the subsea equipment by providing power to a control pod of the subsea equipment to enable the control pod to operate the at least one control element.

12. The method of claim 11, comprising capturing the control signals at a surface location.

13. The method of claim 12, comprising generating electrical power at the surface location and transmitting that power from the surface location to charge a battery of the power unit.

14. The method of claim 11, comprising capturing the control signals from a subsea data carrier.

15. The method of claim 11, comprising providing electrical and hydraulic power from the power unit.

16. The method of claim 15, comprising producing hydraulic power from electric power onboard the power unit.

17. The method of claim 11, comprising charging the battery from a power supply of another item of subsea equipment.

18. The method of claim 11, comprising moving the or each control tool between different locations on the subsea equipment to operate different control elements of the subsea equipment in succession.

19. The method of claim 18, comprising moving the or each control tool by a positioning system distinct from the power unit.

20. The method of claim 11, wherein the remote topside source of control signals is a topside installation connected to the subsea equipment by an umbilical.

* * * * *